US006343909B1

(12) United States Patent
Springer et al.

(10) Patent No.: US 6,343,909 B1
(45) Date of Patent: Feb. 5, 2002

(54) CENTRIFUGAL PUMP

(75) Inventors: Peer Springer, Neuhofen; Wolfgang Kochanowski, Windesheim; Christian Haag, Halle/Saale; Thomas Pensler, Langenbogen, all of (DE)

(73) Assignee: KSB Aktiengesellschaft, Frankenthal (DE)

( * ) Notice: Subject to any disclaimer, the term of this patent is extended or adjusted under 35 U.S.C. 154(b) by 1 day.

(21) Appl. No.: 09/064,132

(22) Filed: Jan. 2, 2001

(30) Foreign Application Priority Data

Apr. 25, 1997 (DE) ..... 197 17 458

(51) Int. Cl.[7] ..... F04D 17/06
(52) U.S. Cl. ..... 415/71; 416/176; 416/188
(58) Field of Search ..... 415/71, 206; 416/185, 416/188, 223 B, 176, 177, 183

(56) References Cited

U.S. PATENT DOCUMENTS

| | | | | |
|---|---|---|---|---|
| 1,839,126 A | | 12/1931 | Sperry | |
| 3,156,190 A | | 11/1964 | Staehle | |
| 3,442,220 A | * | 5/1969 | Mottram et al. | 416/176 |
| 3,602,604 A | * | 8/1971 | Ronellenfitch | 415/72 |
| 4,347,035 A | * | 8/1982 | Stahle | 415/121 B |
| 4,427,336 A | * | 1/1984 | Lake | 415/71 |
| 4,648,796 A | | 3/1987 | Maghenzani | |
| 5,487,644 A | * | 1/1996 | Ishigaki et al. | 415/220 |

FOREIGN PATENT DOCUMENTS

| | | |
|---|---|---|
| DE | AS 1017915 | 10/1957 |
| DE | OS 2642231 | 4/1977 |
| DE | AS 2855385 | 11/1979 |

* cited by examiner

*Primary Examiner*—Edward K. Look
*Assistant Examiner*—Ninh Nguyen
(74) *Attorney, Agent, or Firm*—Crowell & Moring LLP

(57) ABSTRACT

A centrifugal pump with an impeller which has a single helically-formed blade and which is not sensitive to sand abrasion or seizing of the impeller is achieved by providing the impeller (1) with a shielding plate (3) arranged on the suction side which transitions from an axial course given at the suction inlet of the impeller into a radial course, by providing that the blade entry angle ($\beta_1$) in the area which is in danger of cavitation in the event of an abrupt onset of flow is at least 5° smaller than the angle of incident flow ($\beta_0$), and thereafter the blade angle $\beta$ in the axial region of a meridian section through the impeller (1) increases at least to the magnitude of the blade exit angle ($\beta_2$), and finally a blade angle ($\beta$) exceeding the blade exit angle ($\beta_2$) in the radial area of the meridian section decreases back down to the magnitude of the blade exit angle ($\beta_2$).

3 Claims, 3 Drawing Sheets

CENTRIFUGAL PUMP

BACKGROUND OF THE INVENTION

The invention relates to a centrifugal pump with an impeller which has a single blade of spiral shape.

Centrifugal pumps of this kind are disclosed by DE 26 42 231 A1 and DE 28 55 385 B1, among others. The housing and impeller of the previously known centrifugal pumps are matched to one another such that the blade edges form with the housing wall a narrow gap that remains uniform over the entire length of the blade and over the entire rotation of the impeller. Through this gap separating the discharge side from the suction side of the blade a leakage dependent upon the gap width necessarily flows while the pump is running. In a new pump before wear sets, in the loss produced at the edge of the blade and the housing wall is slight.

But since centrifugal pumps of the kind described herein are used chiefly for pumping media containing solids, severe wear at the long, revolving blade edge is unavoidable in many of the applications involved. If, for example, impurities that produce abrasion are contained in the fluid, then even after the centrifugal pump has been in operation but a short time wear is produced which appreciably lowers the original good efficiency of the pump. Such a danger exists in the pumping of communal sewerage, for example, in which the impurities are essentially uncontrollable. For example sand and similar frictionally acting components of the sewage cannot be excluded. The consequence is that centrifugal pumps used in this manner, whose pumping qualities are not tested or inadequately tested after installation, will operate over a long period of time with a steadily diminishing efficiency. This means, however, that such pumps will require unacceptably large power consumption to carry on the tasks assigned to them.

One danger of the previously known centrifugal pumps just described lies in the seizing of the impeller in the housing, which is caused by impurities which can get into the gap that has been enlarged by wear between the blade edge and the housing wall.

Now, impellers of the known kind just described are also provided with a front shielding disk and are thus rendered insensitive to sand abrasion. Certainly the cost, especially for the material, then becomes very high, since in the case of the conical vertical center sections here existing an annular gap must be formed between the shielding disk and the pump housing surrounding the latter. This annular gap, however, has to be kept relatively large, so as to avoid seizing at that location too.

SUMMARY OF THE INVENTION

It is the object of the invention to provide an improved centrifugal pump of the kind referred to above.

Another object of the invention is to provide a centrifugal pump in which the cost of the impeller and housing are low.

A further object of the invention is to provide a centrifugal pump which has a very low sensitivity to abrasive components in the fluid being pumped.

It is also an object of the invention to provide a centrifugal pump in which the danger of the seizing of the impeller in the pump housing will be avoided.

These and other objects have been achieved in accordance with the presently claimed invention by providing a centrifugal pump.

The problems of the prior art centrifugal pumps are overcome by the present invention due to the fact that the impeller has a shielding disk arranged on the suction side, which changes in a curve from an axial trend at the suction port of the impeller to a radial trend, that in the portion of the blade's angle of entry in which there is a danger of cavitation in the event of an abrupt incident flow, the blade's angle of entry is at least 5° smaller than the angle of incident flow, that thereafter the blade angle in the axial portion of a radial section passing through the impeller increases at least to the magnitude of the blade's exit angle, and finally a blade angle exceeding the blade's exit angle in the radial portion of the vertical center section returns again to the magnitude of the blade's exit angle.

The shielding disk used in the centrifugal pump according to the invention forms with the pump housing a gap through which a flow passes radially, and which can be made relatively short and narrow. Thus the problems involved in a conical annular gap are avoided.

The danger of seizing is also avoided, since the curved shielding disk made in accordance with the invention can be surrounded by an ordinarily configured wheel side chamber whose wall is at a relatively great distance from the shielding disk.

The cost of material and manufacture of the impeller of the invention, and of the pump housing, remains low.

The invention makes allowance for the circumstance that single impellers are basically very sensitive to cavitation, by providing for an especially shaped axial entry portion of the impeller. For if the blade's angle of entry is made substantially smaller in the area in danger of cavitation by abrupt incident flow, then cavitation is avoided.

The blade angle in the area adjoining the impeller entry must necessarily increase considerably. In order to realize the transition from the axial shape of the impeller to the radial shape, the blade angle in the above-mentioned area in danger of cavitation merges in the radial part, after a steep rise in the axial part of the impeller, with the blade's exit angle.

If the rise created in the axial part exceeds the magnitude of the blade's exit angle, this means that in the radial part the blade angle has to return to the magnitude of the blade's exit angle.

BRIEF DESCRIPTION OF THE DRAWINGS

The invention will be explained in further detail with reference to an illustrative embodiment depicted in the accompanying drawings in which.

DETAILED DESCRIPTION OF PREFERRED EMBODIMENTS

Figure 1:
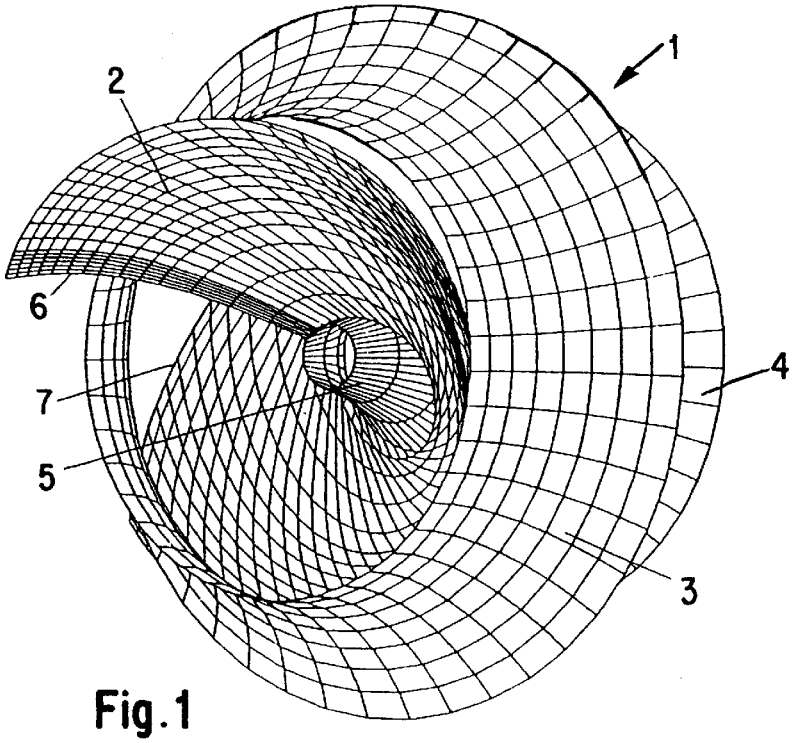
FIG. 1 shows a three-dimensional representation of an impeller according to the invention, with a front shielding disk partially removed.

The impeller 1 represented in FIG. 1 has a blade 2 of helical configuration which is arranged between a front, suction-end shielding disk 3 and a rear, discharge-end shielding disk 4. The blade turns around a boss 5 of substantially conical shape.

In order better to recognize the shape of the blade 2, a portion of the front shielding disk 3 has been omitted. The drawing shows the skeletal surfaces of the blade 2 and of the shielding disks 3 and 4, i.e., the particular thickness of the parts in question is disregarded. The blade 2 has an entry edge 6 and an exit edge 7.

Figure 6:
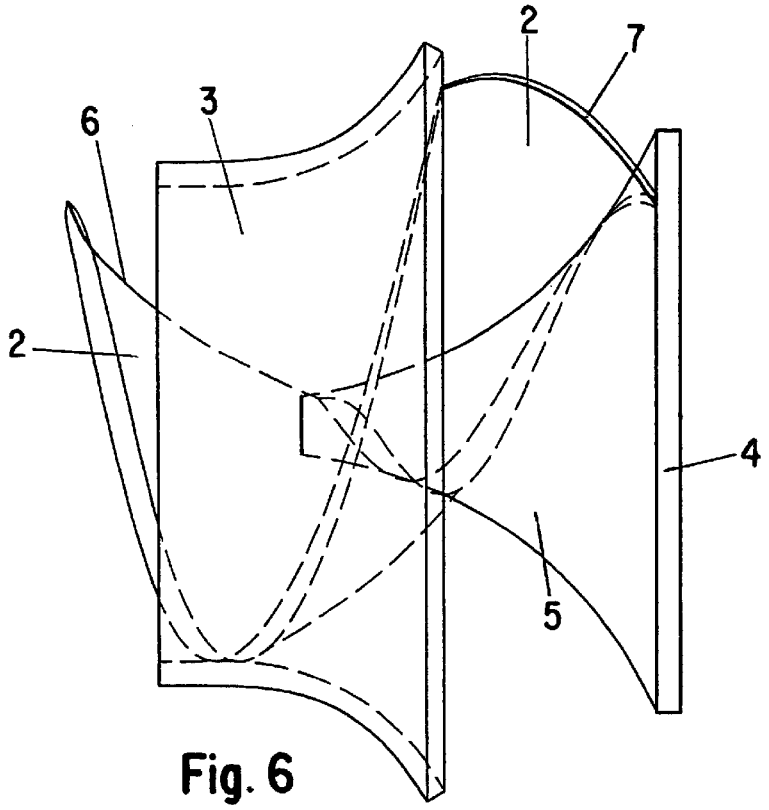
FIG. 6 shows a side elevation of the impeller of FIG. 1.
Figure 7:
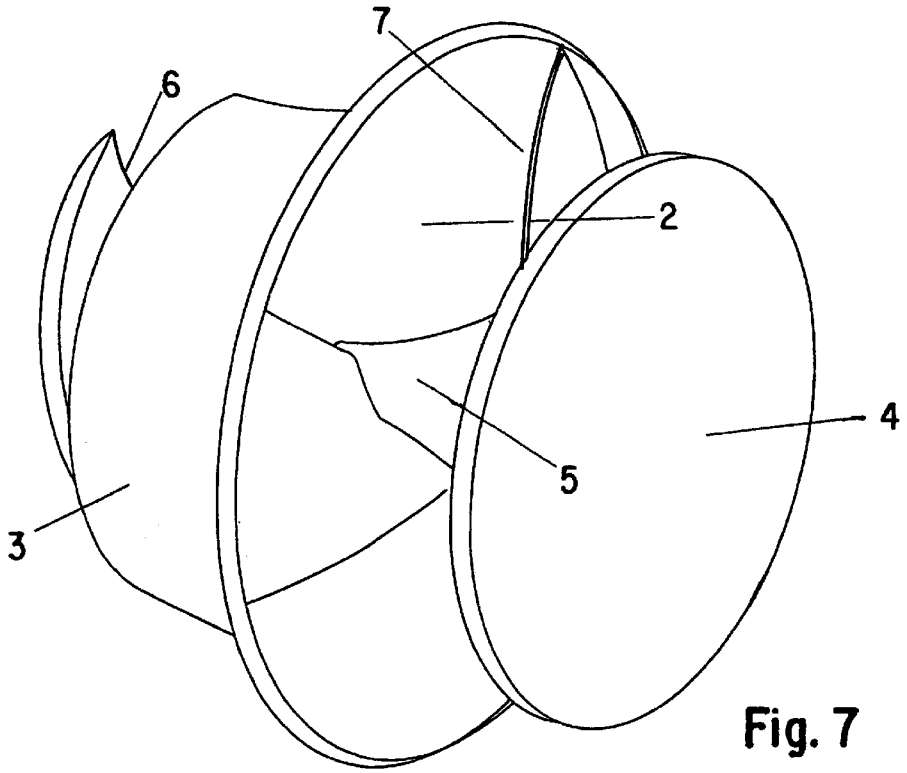
FIG. 7 shows a rear perspective view of the impeller of FIG. 1.

The configuration of the impeller is also shown in FIGS. 6 and 7.

Figure 2:
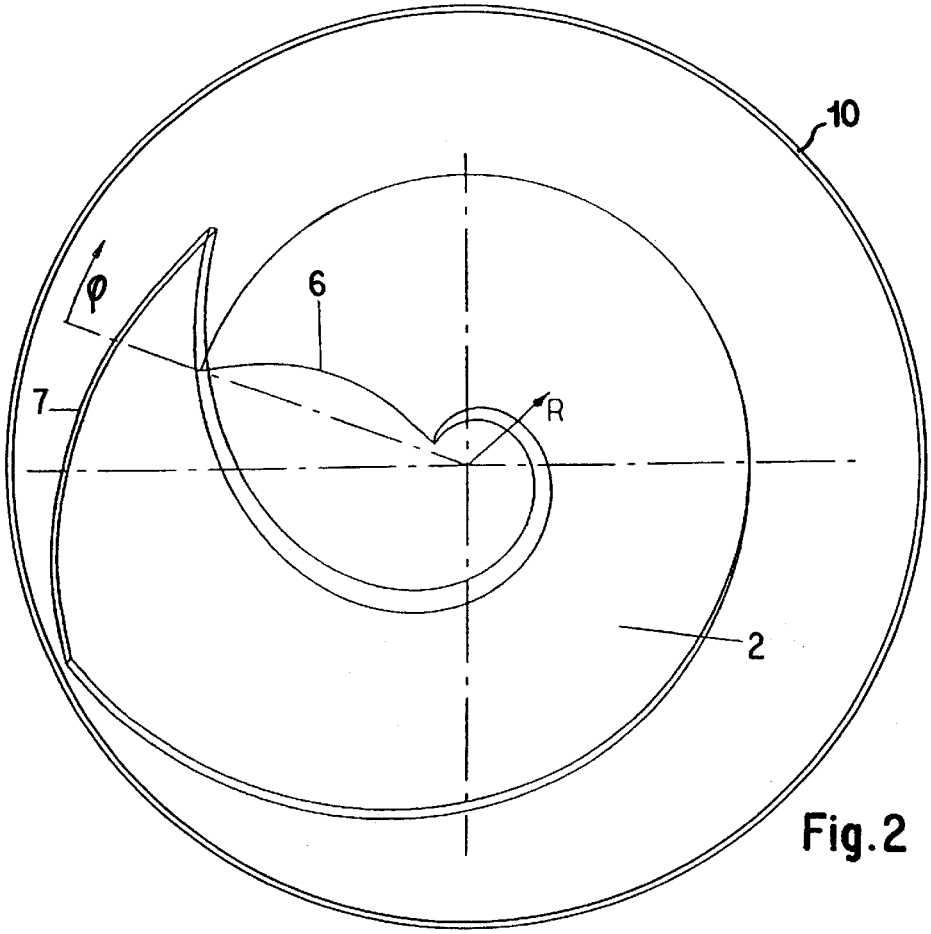
FIG. 2 shows a front elevation of the blade of the impeller of FIG. 1.

In FIG. 2, the blade 2 is represented in front elevation without the adjacent parts, the front shielding disk 3, rear shielding disk 4 and boss 5. Also seen here are the entry edge 6 and the exit edge 7 and a pump housing 10. Arrows indicate the radius R and the looping angle $\phi$, which relate to the blade 2 and vary with its curvature.

Figure 3:
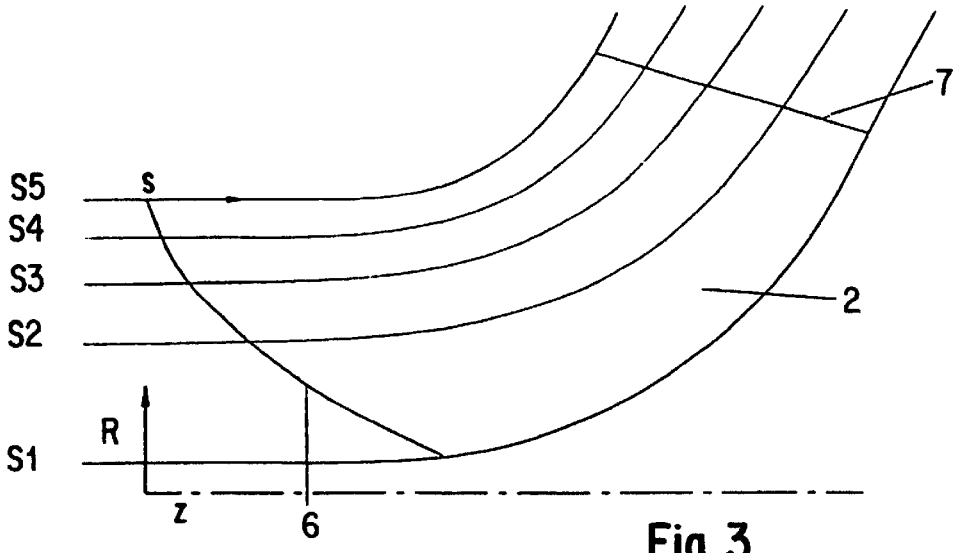
FIG. 3 shows a radial section through the blade of the impeller of FIG. 1 with the curvature of five different streamers.

The radius R, which begins from the axis Z of the impeller 1, is also shown in FIG. 3. Furthermore, in FIG. 3 the coordinate s along the meridian flow line of the blade 2 is represented. Finally, streamers S1 to S5 are drawn in the central section of the blade 2 running between the entry edge 6 and the exit edge 7 of the blade.

Figure 4:
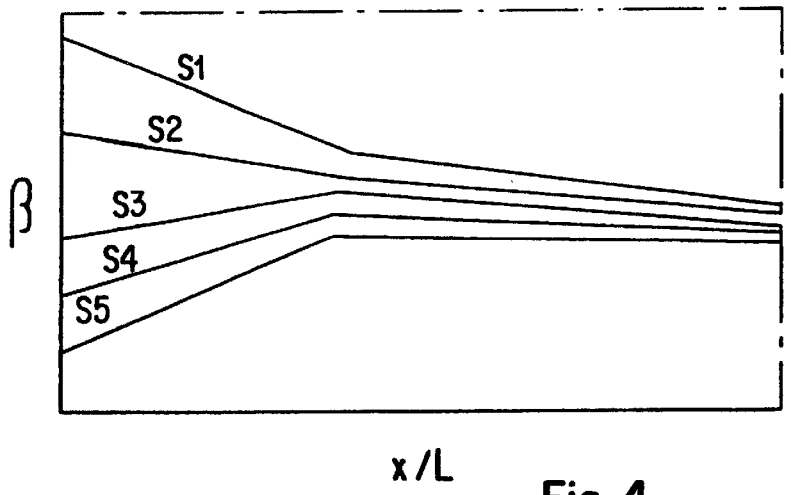
FIG. 4 shows the angular course of the blade's skeleton line corresponding to the streamers of FIG. 3.

In FIG. 4 it can be seen how the angle $\beta$ of the streamers S1 to S5 changes with the ongoing progression x/L. Above all it can be seen that the angle $\beta$ of the streamers S3 to S5 situated in the area in danger of cavitation will initially increase from a small starting value and then, after reaching a maximum, it will slope down slightly toward the end of the blade.

The angle of attack $\beta_0$ of the liquid being pumped by the impeller is not shown in the drawing. It is at least 5° greater than the blade's entry angle, $\beta_1$ in the area in danger of cavitation in the event of an abrupt onset of flow.

Figure 5:
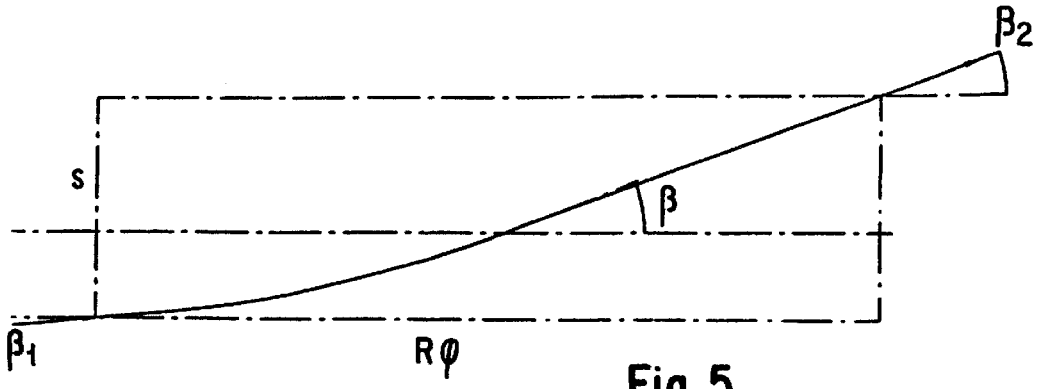
FIG. 5 shows a conformal image of the blade in the area of one streamer in FIG. 3.

The shape of angle, $\beta$ between the blade entry angle, $\beta_1$ at the entry edge 6 and the blade exit angle $\beta_2$ at the exit edge 7 can be seen in FIG. 5 with reference to a conformal image of the blade 2 in the area of the streamer S5. In this drawing, too, it becomes clear that the angle, $\beta$ increases to a maximum (marked here by a broken line) and thereafter decreases slightly.

What is claimed is:

1. A centrifugal pump with an impeller having a single blade of helical shape, a suction side and a discharge side, the impeller including an entry edge, an axial shape area, a radial shape area and an exit edge, the blade having a blade entry angle varying along the entry edge and a blade exit angle varying along the exit edge, wherein the impeller has a shielding plate disposed on the suction side, the shielding plate curving from an axial trend at the suction side to a radial trend toward the discharge side, a first portion of the blade having the blade entry angle corresponding to an incident flow angle, a second portion of the blade in an area in danger of cavitation from shock approach flow having the blade entry angle at least 5° smaller than the incident flow angle, axially thereafter, the blade angle in the axial shape area increasing at least to the magnitude of the blade exit angle, and the blade angle exceeding the blade exit angle in the radial shape area decreasing to the magnitude of the blade exit angle.

2. A centrifugal pump according to claim 1, wherein the second portion of the blade is located radially outwardly from the first portion of the blade.

3. An impeller for a centrifugal pump having a single blade of helical shape, a suction side and a discharge side, the impeller including an entry edge, an axial shape area, a radial shape area and an exit edge, the blade having a blade entry angle varying along the entry edge and a blade exit angle varying along the exit edge, wherein the impeller has a shielding plate disposed on the suction side, the shielding plate curving from an axial trend at the suction side to a radial trend toward the discharge side, a first portion of the blade having the blade entry angle corresponding to an incident flow angle, a second portion of the blade in an area in danger of cavitation from shock approach flow having the blade entry angle at least 5° smaller than the incident flow angle, axially thereafter, the blade angle in the axial shape area increasing at least to the magnitude of the blade exit angle, and the blade angle exceeding the blade exit angle in the radial shape area decreasing to the magnitude of the blade exit angle.

* * * * *